US005346200A

United States Patent [19]

Sarvik et al.

[11] Patent Number: 5,346,200

[45] Date of Patent: Sep. 13, 1994

[54] CONVERTED CONTAINER END BAG SEPARATOR

[75] Inventors: Steve Sarvik, Oxie; Gert Hellstrom; Denniver Olsson, both of Malmo, all of Sweden

[73] Assignee: BallCorporation, Muncie, Ind.

[21] Appl. No.: 32,673

[22] Filed: Mar. 17, 1993

[51] Int. Cl.[5] ..... B65H 3/08

[52] U.S. Cl. ..... 271/102; 271/106; 414/797.8

[58] Field of Search ..... 271/11, 99, 102, 106, 271/107, 100, 101; 414/797.8

[56] References Cited

U.S. PATENT DOCUMENTS

| | | | |
|---|---|---|---|
| 1,682,276 | 8/1928 | Hartman | 271/101 |
| 2,859,036 | 11/1958 | Petrea | 271/102 |
| 3,448,977 | 6/1969 | Stemmler | 271/100 X |
| 3,458,042 | 7/1969 | Mestre | 271/11 X |
| 3,878,945 | 4/1975 | Mojden et al. | 214/7 |
| 3,962,845 | 6/1976 | Mojden et al. | 53/59 R |
| 4,251,977 | 2/1981 | Wakamatsu et al. | 53/443 |
| 4,395,864 | 8/1983 | Anderson et al. | 53/532 |
| 4,397,131 | 8/1983 | Anderson | 53/254 |
| 4,417,435 | 11/1983 | Wakamatsu et al. | 53/532 |
| 4,442,652 | 4/1984 | Wakamatsu et al. | 53/258 |
| 4,442,654 | 4/1984 | Wakamatsu et al. | 53/266 R |
| 4,537,010 | 8/1985 | Mojden et al. | 53/447 |
| 5,119,617 | 6/1992 | Mojden et al. | 53/500 |

*Primary Examiner*—Richard A. Schacher
*Attorney, Agent, or Firm*—Gilbert E. Alberding

[57] ABSTRACT

An assembly is provided for separating a bag from a stack of bags. The assembly comprises a bag magazine having a bottom portion for supporting a stack of bags and a cutout section in the bottom portion. A gripping member is employed for engaging a bag in said magazine adjacent said bottom portion. A moving device is further provided for moving the gripping member between at least first and second positions, wherein the gripping member engages a bag through the cutout section when in the first position and wherein the second position is horizontally displaced from the cutout section. Movement of the gripping member from the first position to the second position while engaging the bag slidably removes the bag from the bag magazine.

23 Claims, 2 Drawing Sheets

CONVERTED CONTAINER END BAG SEPARATOR

FIELD OF THE INVENTION

The present invention generally relates to the production of containers and, more particularly, to a method and apparatus for separating a bag for container ends from a stack of bags.

BACKGROUND OF THE INVENTION

In the container-making industry, containers are typically manufactured in at least two parts: a container body and at least one container end. The container body may be drawn and ironed such that only a single container end is required (two-piece container), or the container body may be formed by rolling a stamped sheet into cylindrical form and welding the seam such that two container ends are required (three-piece container). Regardless of the particular container structure, container manufacturers typically separately supply large quantities of container bodies and container ends to customers who introduce substances into the container bodies and subsequently attach the container end(s) to the container body. In this regard, a predetermined number or "stick" of container ends are typically packaged by the manufacturer in face-to-face relation in cylindrical bags having a diameter slightly greater than the container ends for shipment to the customer.

The bagging operation typically entails the separation of a bag from a stack of bags and the subsequent presentation of the bag to a bag loading station. The separation and presentation steps can be done manually or, to improve the efficiency of the process, automatically with a bag separating device. Generally representative of automatic bag separating devices are U.S. Pat. No. 4,537,010 to Mojden et al., issued Aug. 27, 1985; U.S. Pat. No. 4,442,652 to Wakamatsu et al., issued Apr. 17, 1984; U.S. Pat. No. 4,395,864 to Anderson et al., issued Aug. 2, 1983; U.S. Pat. No. 3,962,845 to Mojden et al., issued Jun. 15, 1976; and U.S. Pat. No. 3,878,945 to Mojden et al., issued Apr. 22, 1975.

Although the above-referenced types of devices can be employed to automate a bag separating process, many of these devices tend to be space-consuming, slow to operate at production capacities, and/or unnecessarily complex due to the large numbers of moving parts. Of particular importance, some of the above-referenced devices have a tendency to undesirably remove more than one bag at a time. Consequently, it is an object of the present invention to provide a compact, low-cost, efficient automatic bag separating device for consistently removing a single bag from a stack of bags.

SUMMARY OF THE INVENTION

Accordingly, the present invention is embodied in an assembly particularly adapted to slidably remove a container end bag from the bottom of a stack of bags. The assembly generally includes a bag magazine having a cut out portion, a horizontal cylinder, a vertical cylinder, and a gripping member.

In one embodiment, the bag magazine holds a stack of empty bags such that a gripping member (e.g., a suction cup(s) operatively connected to a suction source) may engage the bag on the bottom of the stack and remove it therefrom, preferably such that the potential for more than one bag being removed at a time is reduced. In this regard, the bottom of the magazine has a cutout portion to provide access to the bottom bag. With the gripping member being substantially aligned with the cutout portion of the magazine, the gripping member engages the bottom bag and removes it from the magazine by movement of the gripping member to a second position where the gripping member is no longer aligned with the cutout section. As a result, the bottom bag is effectively slid out from the bottom of the stack while the rest of the stack is kept in place by the magazine (e.g. by a wall thereof), thereby reducing the likelihood of inadvertently removing more than one bag at a time. As can be appreciated, the motion of the gripping member which removes the bag from the magazine may be provided by motion in a first direction (e.g., substantially vertical) and thereafter by motion in a second direction (e.g., substantially horizontal), or by a single motion (e.g., a combination of motions in the first and second directions to provide a linear motion having both a vertical and horizontal component). Upon removal of the bag from the magazine, the bag can be horizontally transported to a bag loading station.

DETAILED DESCRIPTION

Figure 3:
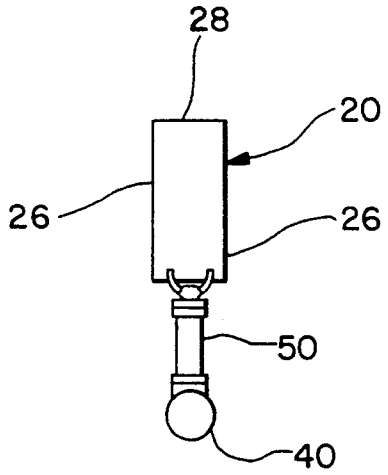
FIG. 3 is an end elevational view of the bag separating assembly.

The present invention will be described with regard to the accompanying drawings which assist in illustrating the pertinent features thereof. In this regard, the bag separating assembly 10 is generally illustrated in FIGS. 1–3. For ease of description, in the discussion of the assembly 10 the following terminology will be used. The direction of flow of the container ends will be termed the "downstream direction" and corresponds with movement from right to left in FIGS. 1–2. The opposite direction will be termed the "upstream direction" and corresponds with movement from left to right in FIGS. 1–2.

The assembly 10 includes a longitudinally-extending bag magazine 20, a horizontal cylinder 40, a vertical cylinder 50, and a suction members 60 for sliding an empty bag 70 from the bottom of the stack 72. In this regard, the bag magazine 20 includes a bottom 22, a front wall 24, and two side walls 26 forming a rectangular box-like structure dimensioned to receive a stack 72 of collapsed bags. The top 28 and back 30 of the magazine 20 is open so that the supply of bags 70 can be replenished to the magazine 20 during operation of the assembly 10. A cut-out portion 32 is provided at the upstream end of the bottom 22 of the magazine 20 to provide access to the bottom of the stack of bags 72 by the suction members 60.

The suction members 60 are mounted on the vertical cylinder 50 which is further mounted on the horizontal cylinder 40. It should be appreciated that the suction members 60 of the present invention could comprise any device that could adequately engage a bag such as, for example, an adhesive member or a mechanical gripping device.

A trough 80 is positioned in alignment with and upstream of the magazine 20 and acts as a support for the bag 70 after it is removed from the magazine. The trough 80 includes a slotted portion 82 to allow for movement of the suction members 60 therebetween during and after removal of the bag 70 from the magazine 20.

Figure 1A:
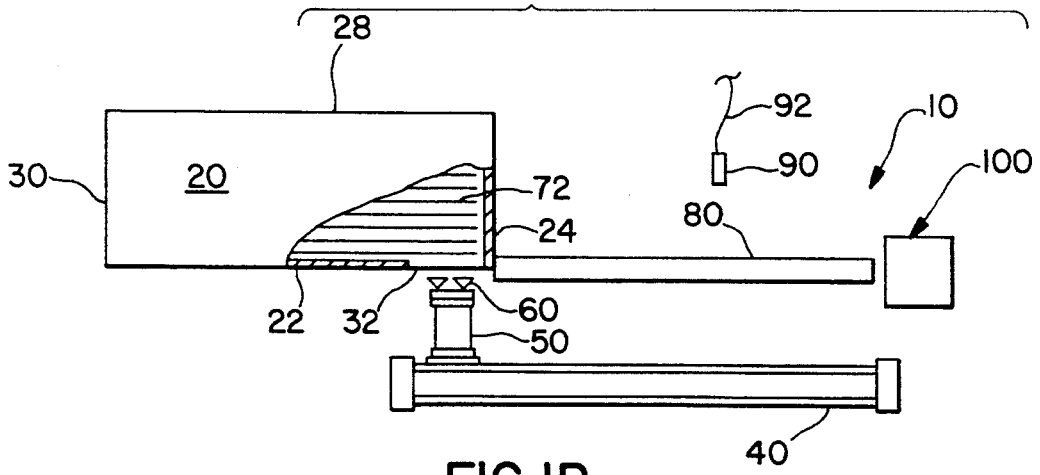
FIG. 1*a* is a side elevational view of the bag separating assembly with the assembly in the at-rest position.
Figure 1B:
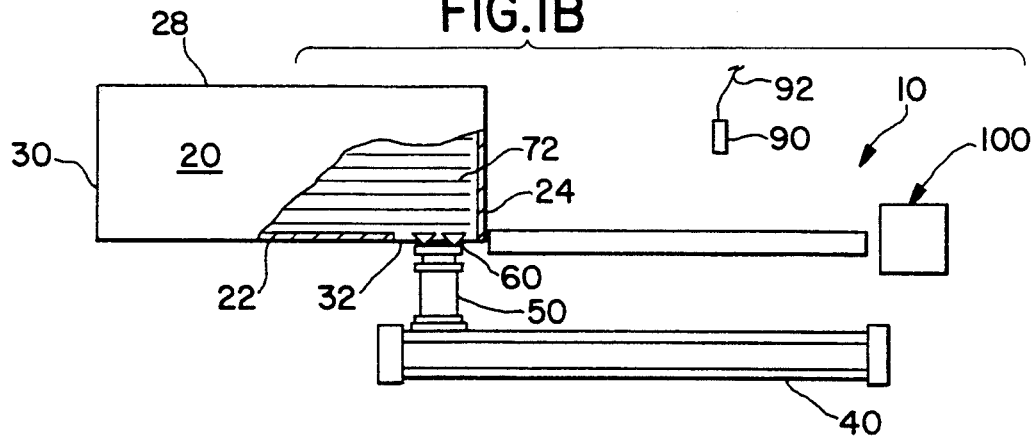
FIG. 1*b* is a side view of the assembly shown in FIG. 1*a* with the assembly in the engaged position.
Figure 1C:
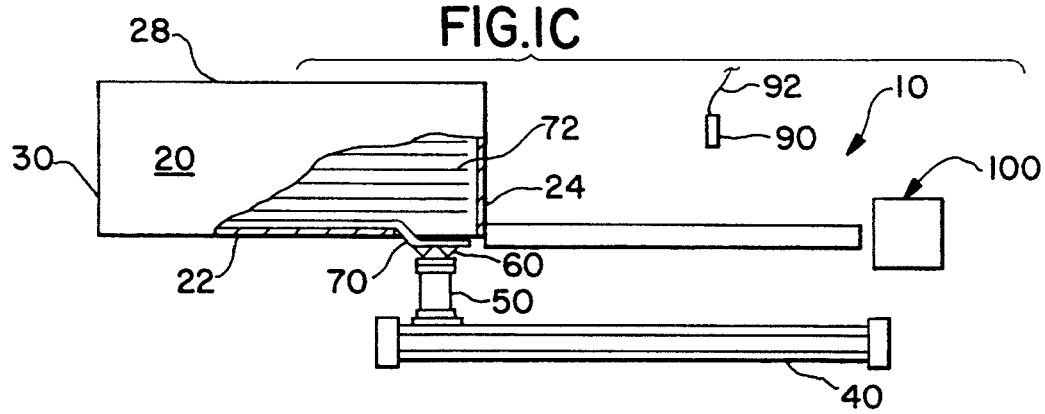
FIG. 1*c* is a side view of the assembly shown in FIG. 1*a* with the assembly in the lowered position.
Figure 1D:
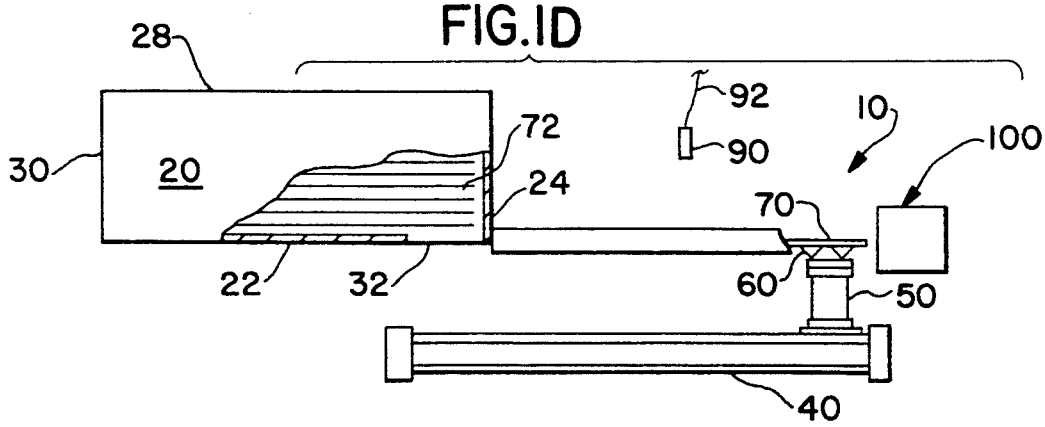
FIG. 1*d* is a side view of the assembly shown in FIG. 1*a* with the assembly in the transported position.
Figure 2:
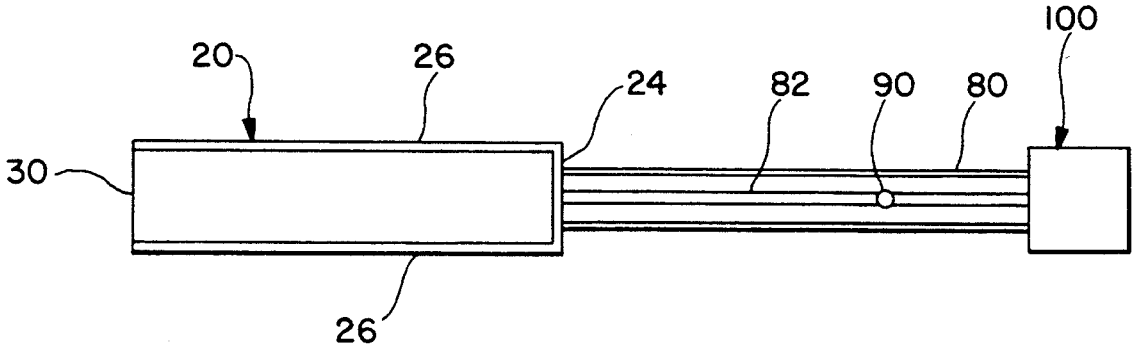
FIG. 2 is a top plan view of the bag separating assembly.

Referring specifically to FIGS. 1*a*–1*d*, the operation of the bag separating assembly 10 is as follows. When a bag sensor 90 senses that a bag 70 is needed, the bag sensor 90 sends a signal to a control circuit (not shown) via bag sensor interconnect 92. Upon receiving the signal, the control circuit starts operation of the assembly 10. All further reference to movement and timing of assembly components are controlled by the control circuit (not shown). In operation, the vertical cylinder 50 raises the suction members 60 through the cut-out portion 32 of the magazine 20 and into engagement with the bottom bag 70 of the stack 72 as shown in FIG. 1*b*. Suction is applied at the suction members 60 such that engagement with the bottom bag 70 in the magazine 20 is maintained. The vertical cylinder 50 is then withdrawn to a point where the suction members 60 are level with, or slightly above or below, the bottom 84 of the trough 80 while engagement with the bag 70 is maintained as shown in FIG. 1*c*. At this point, the bag 70 has been partially removed from the magazine 20. Finally, the horizontal cylinder 40 transports the suction members 60 further upstream while engagement with the bag 70 is maintained. The movement of the horizontal cylinder 40 is substantially longitudinally aligned with the bag magazine 20. The upstream movement of the suction members 60 results in the bag 70 being fully removed from the magazine 20 by a sliding action relative to the stack of bags 72 remaining in the magazine 20, as shown in FIG. 1*d*. Because the front wall 24 of the magazine 20 extends slightly lower than the bottom of the stack of bags 72, the bags immediately above the bottom bag 70 are held in place and prevented from sliding out of the magazine 20 while the bottom bag 70 is being removed. Although such movements were described as having a distinct two-component motion (vertical, and then horizontal), the motion could be a single linear motion having vertical and horizontal components or purely horizontal components. After the bag 70 has been fully removed form the magazine 20, the suction members 60 can further horizontally transport the bag 70 upstream to a bag loading station 100 (e.g. comprising a bagging horn).

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

We claim:

1. An assembly for separating a cylindrical bag, sized to receive container ends, from a stack of such cylindrical bags at a first location, and for positioning the cylindrical bag to a second location to receive a stick of nested container ends therein, said assembly comprising:

a longitudinally extending bag magazine having a bottom portion for supporting a stack of cylindrical bags, said bottom portion having a cutout section;

a gripping member for engaging a cylindrical bag in said magazine at said first location;

an elongated bag support for longitudinally supporting the cylindrical bag when the bag is at said second location, said second location being above said bag support and completely separate from said first location; and means for moving said gripping member to position a cylindrical bag from said first location to said second location, wherein a cylindrical bag is engageable by said gripping member through said cutout section at said first location, and wherein said second location is longitudinally displaced from said first location, whereby movement of said gripping member to position a cylindrical bag from said first location to said second location slidably removes the cylindrical bag from said bag magazine.

2. An assembly, as claimed in claim 1, wherein said gripping member comprises:

at least one suction cup; and a suction device operatively connected to said at least one suction cup.

3. An assembly, as claimed in claim 1, wherein said means for moving comprises:

a vertical actuator for vertical movement; and a horizontal actuator for horizontal movement.

4. An assembly, as claimed in claim 1, wherein said bag magazine is substantially horizontal so as to substantially horizontally support the cylindrical bags at said first location.

5. An assembly, as claimed in claim 1, wherein said bag support is substantially horizontal so as to substantially horizontally support the cylindrical bag at said second location upon receipt container ends therein.

6. An assembly, as claimed in claim 1, wherein said bag support includes a longitudinal access for receiving said gripping member while said gripping member positions a cylindrical bag from said first location to said second location.

7. An assembly, as claimed in claim 1, wherein said bag support is substantially aligned with said bag magazine.

8. An assembly, as claimed in claim 1, wherein said bag support comprises a trough sized to receive container ends and having a longitudinal access slot therethrough for receiving said gripping member while said gripping member positions a cylindrical bag from said first location to said second location.

9. An assembly, as claimed in claim 1, wherein said means for moving comprises a longitudinal frame member, and wherein said gripping member is mounted on said means for moving and is longitudinally slidable relative to said frame member.

10. An assembly, as claimed in claim 9, wherein said bag support is longitudinally extending, and wherein said frame member comprises a first linear actuator for moving said gripping member substantially parallel to a longitudinal extent of said bag support.

11. An assembly, as claimed in claim 10, wherein said first linear actuator is substantially aligned with said bag magazine.

12. An assembly, as claimed in claim 10, wherein said first linear actuator is substantially horizontally disposed.

13. An assembly, as claimed in claim 9, wherein said means for moving further comprises a telescoping member for interconnecting said gripping member with said frame member.

14. An assembly, as claimed in claim 13, wherein said bag support is longitudinally extending, and wherein said telescoping member comprises a second linear actuator for moving said gripping member substantially perpendicular to a longitudinal extent of said bag support.

15. An assembly, as claimed in claim 14, wherein said telescoping member is substantially vertically disposed.

16. An assembly, as claimed in claim 1, further comprising:

control means for controlling actuation of said assembly; and a sensor, operatively connected to said control means, for detecting the absence or presence of a cylindrical bag at said second location, whereby said control means will not actuate said assembly to separate a new cylindrical bag if said sensor indicates that a cylindrical bag is present at said second location.

17. An assembly, as claimed in claim 1, further comprising:

a container end loading station positioned adjacent to and in alignment with said bag support, whereby the cylindrical bag is presented to said container end loading station when the cylindrical bag is at said second location.

18. An assembly, as claimed in claim 1, wherein said gripping member maintains engagement with the cylindrical bag at least until the cylindrical bag is completely removed from said bag magazine.

19. A method for separating a cylindrical bag, sized to receive container ends, from a stack of such cylindrical bags contained within a longitudinally extending bag magazine at a first location, and for positioning the cylindrical bag over a bag support at a second location to receive a stick of nested container ends therein, wherein the bag magazine has a bottom portion for supporting the stack of bags and a cutout section, said method comprising the steps of:

positioning a gripping member adjacent the cutout section whereby a bag at the first location is engageable by said gripping member;

engaging the bag at the first location with said gripping member; and moving said gripping member to position the cylindrical bag from the first location to the second location, wherein the second location is longitudinally displaced from and completely separate from the first location to slidably remove the cylindrical bag from said bag magazine.

20. A method, as claimed in claim 19, wherein said moving step comprises:

vertically moving said gripping member to move at least a portion of the cylindrical bag from the first location vertically downward to an intermediate location; and horizontally moving said gripping member to move the cylindrical bag from said intermediate location to said second location over the bag support.

21. An assembly for separating a cylindrical bag, sized to receive container ends, from a stack of such cylindrical bags at a first location, and for positioning the cylindrical bag to a second location to receive a stick of nested container ends therein, said assembly comprising:

a longitudinally extending bag magazine having a bottom portion for supporting a stack of cylindrical bags, said bottom portion having a cutout section;

a gripping member for engaging a cylindrical bag in said magazine at said first location;

an elongated bag support for longitudinally supporting the cylindrical bag when the bag is at said second location, said second location being above said bag support and completely separate from said first location; and means for moving said gripping member to position a cylindrical bag from said first location to said second location, wherein a cylindrical bag is engageable by said gripping member through said cutout section at said first location, wherein said second location is longitudinally displaced from said first location, wherein said means for moving comprises a first linear actuator for moving said gripping member substantially parallel to a longitudinal extent of said bag support and a second linear actuator for moving said gripping member substantially perpendicular to a longitudinal extent of said bag support, whereby movement of said gripping member to position a cylindrical bag from said first location to said second location slidably removes the cylindrical bag from said bag magazine.

22. An assembly, as claimed in claim 21, wherein said bag support comprises a trough sized to receive container ends and having an access slot therethrough for receiving said gripping member while said gripping member positions a cylindrical bag from said first location to said second location.

23. An assembly, as claimed in claim 21, further comprising:

control means for controlling actuation of said assembly; and a sensor, operatively connected to said control means, for detecting the absence or presence of a cylindrical bag at said second location, whereby said control means will not actuate said assembly to separate a new cylindrical bag if said sensor indicates that a cylindrical bag is present at said second location.

* * * * *